US009447603B2

(12) United States Patent
Simmons

(10) Patent No.: US 9,447,603 B2
(45) Date of Patent: Sep. 20, 2016

(54) UNIVERSAL BIFURCATED STANCHION FOR HANDRAIL SYSTEMS

(71) Applicant: Howard C. Simmons, Hollister, CA (US)

(72) Inventor: Howard C. Simmons, Hollister, CA (US)

( * ) Notice: Subject to any disclaimer, the term of this patent is extended or adjusted under 35 U.S.C. 154(b) by 205 days.

(21) Appl. No.: 14/533,552

(22) Filed: Nov. 5, 2014

(65) Prior Publication Data

US 2016/0123035 A1 May 5, 2016

(51) Int. Cl.
*E04H 17/22* (2006.01)
*E04H 12/22* (2006.01)

(52) U.S. Cl.
CPC ..... *E04H 17/22* (2013.01); *E04H 12/2261* (2013.01)

(58) Field of Classification Search
CPC ..... E04H 17/22; E04H 17/24; E04H 12/22; E04H 12/2253; E04H 12/2261; E04H 12/2276; E04F 11/1812
See application file for complete search history.

(56) References Cited

U.S. PATENT DOCUMENTS

| | | | | |
|---|---|---|---|---|
| 3,977,654 | A | 8/1976 | Etherington et al. | |
| 4,015,827 | A | 4/1977 | Brand | |
| 6,336,620 | B1 * | 1/2002 | Belli | E04F 11/1812 248/346.01 |
| D475,995 | S | 6/2003 | Hsieh | |
| 6,905,110 | B2 * | 6/2005 | Brown | E04F 11/1812 248/519 |
| D559,405 | S | 1/2008 | Tuncel | |
| 7,866,636 | B1 | 1/2011 | Hansen | |
| D640,074 | S | 6/2011 | Hamilton et al. | |
| 8,117,798 | B2 * | 2/2012 | Bergman | E04H 12/2253 256/65.14 |
| 2004/0245516 | A1 * | 12/2004 | Fuoco | E04F 11/1812 256/65.14 |
| 2006/0022189 | A1 * | 2/2006 | Collins, IV | E04H 17/20 256/65.14 |
| 2006/0037265 | A1 * | 2/2006 | Leek | E04B 1/24 52/295 |
| 2006/0186391 | A1 | 8/2006 | Hansen | |
| 2014/0299829 | A1 * | 10/2014 | Herman | B23K 31/02 256/46 |

FOREIGN PATENT DOCUMENTS

| | | | | |
|---|---|---|---|---|
| CA | 2446954 | A1 * | 11/2002 | E04B 2/7433 |
| DE | WO 9722769 | A2 * | 6/1997 | E04H 12/2261 |
| DE | 202014008316 | U1 * | 12/2014 | E04H 12/2276 |

* cited by examiner

*Primary Examiner* — Jonathan Masinick
(74) *Attorney, Agent, or Firm* — J. E. McTaggart

(57) ABSTRACT

A novel stanchion, for insertion into and support of a tubular post of a handrail system for installation on a horizontal surface, slope or staircase, is configured with a bottom flange attached to a tubular upright portion. The upright portion is bifurcated, forming a mirror-image pair of arcuate sidewalls separated at side edges by a pair of vertical slots extending upwardly from closed low ends near the flange to open ends at the top of the upright portion. The slots are sized in width to allow passage of a handrail system bottom safety member passing through a pair of drilled holes in the post at any desired spacing above the flange, with never any need for drilling the stanchion. If required to ensure against deformation of the upright portion from external forces impacting the handrail system, reinforcement can be selectably located and deployed in a manner that avoids interference with any desired location of the bottom safety member.

18 Claims, 3 Drawing Sheets

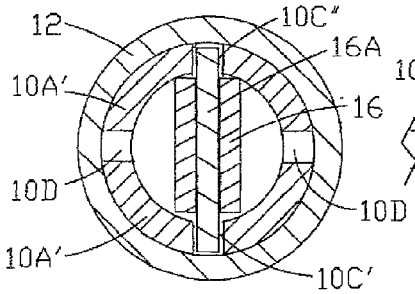
FIG. 20
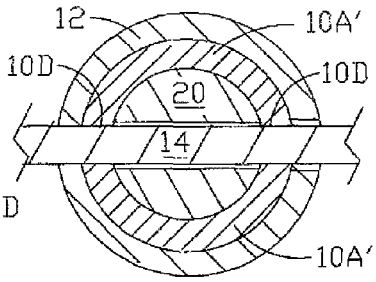
10A′ FIG. 22
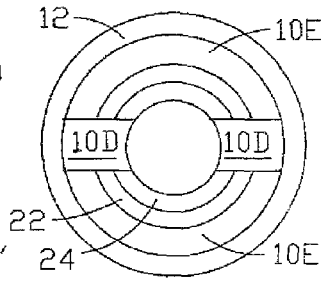
FIG. 24
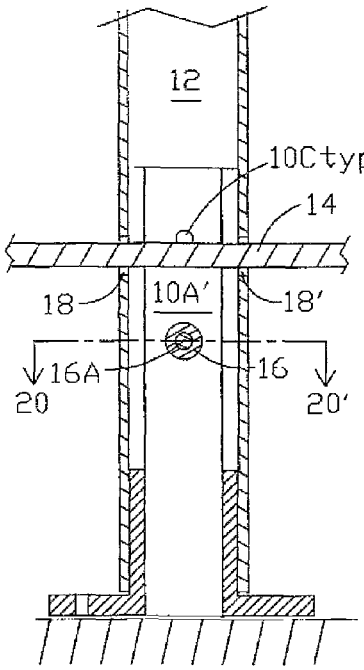
FIG. 19
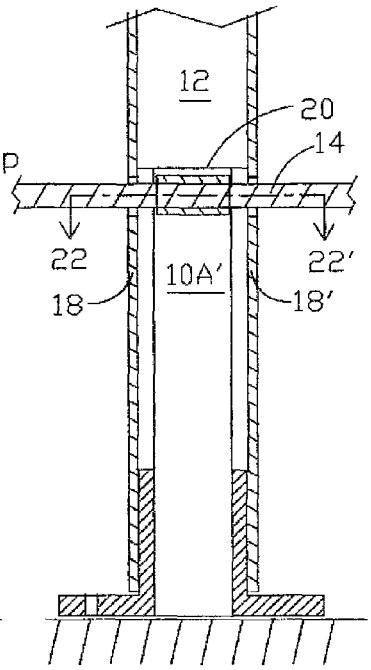
FIG. 21
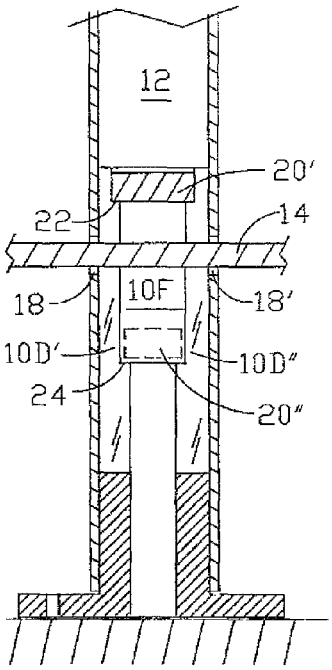
FIG. 23
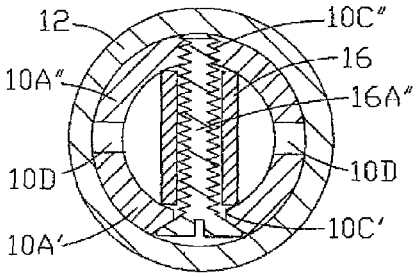
FIG. 25
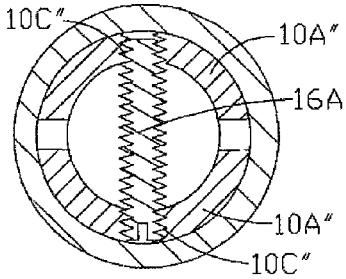
FIG. 26
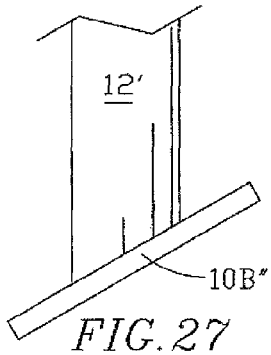
FIG. 27

UNIVERSAL BIFURCATED STANCHION FOR HANDRAIL SYSTEMS

FIELD OF THE INVENTION

The present invention is in the field of handrails including indoor and outdoor handrail systems installed over flat horizontal surfaces, inclined surfaces and stairs, with safety members extending between posts. More particularly it relates to stanchions for supporting posts of handrail systems designed for horizontal surfaces, sloping surfaces and stairs.

BACKGROUND OF THE INVENTION

Handrails, whether above horizontal surfaces, slopes or stairs, are generally supported on a series of posts whose lower ends are fastened to the underlying base surface via some form of stanchion. As the structural "backbone" of a handrail system, the stanchion is required to withstand high levels of stress whenever the handrail is impacted by strong external force. For child protection and public safety, building code regulations call for some form of safety grillwork or mesh extending across the space between the posts, typically extending down to a bottom safety member. Safety, building and code regulations limit the separation between safety members, and also limit the spacing between the bottom safety member and the underlying base surface, thus raising physical interference issues since installation of the bottom safety member requires it to pass through the posts in the same low end region already necessarily occupied by the stanchions.

Many different design approaches have been created to balance the conflicting demands of facilitating installation and meeting code requirements while also enabling freedom in ornamental and architectural design. Virtually all known handrail systems have as a common basis a bottom safety member which is often implemented as a wire, rod, twisted or braided cable or equivalent, usually of metal, e.g. stainless steel, or alternatively, suitably strong plastics, fiberglass/epoxy, carbon fibre and the like. Commonly the bottom safety member is procured in continuous length and passed through each post; typically requiring drilling through the posts as required at installation.

If the post is hollow and based on a stanchion, the standing portion of the stanchion must extend far enough up into the lower end of the post to ensure required overall handrail structural strength, especially to withstand strong lateral forces impacting the handrail region, which by leverage, translate to extremely high compressive and bending stresses on the stanchions at the low end of the posts. In practice, the stanchion height is typically made to extend above the upper limit for height of the bottom safety member allowed by code, while the height selected for ornamental design purposes can range far below the code limit, consequently installation of handrail systems using stanchions of known art routinely requires drilling not only through the hollow post walls but also through the (usually solid steel) stanchion, a burden that makes installation very tedious, time-consuming and costly.

OBJECTS OF THE INVENTION

It is a primary object of the invention to provide a versatile "universal" handrail post stanchion that will save labor and facilitate installation of virtually all railing posts and associated post-to-post structural arrangements including installations on stairs, slopes and on flat horizontal base surfaces without requiring any drilling or other modification of the stanchions at installation.

It is a further object to provide an alternative to making the upright portion of the stanchion in solid form, to yield material, weight, labor and overall cost savings, while preserving the needed strength.

SUMMARY OF THE INVENTION

The forgoing objects have been accomplished in the present invention of a novel stanchion, for insertion into and support of a tubular post of a handrail system for installation on a horizontal surface, slope or staircase. The stanchion is configured with a bottom flange attached to a tubular upright portion. The upright portion is bifurcated, forming a mirror-image pair of arcuate sidewalls separated at side edges by a pair of vertical slots extending upwardly from closed low ends near the flange to open ends at the top of the upright portion. The slots are sized in width to allow passage of a handrail system bottom safety member passing through a pair of drilled holes in the post at any desired spacing above the flange, with never any need for drilling the stanchion. If required to ensure against deformation of the upright portion from external forces impacting the handrail system, reinforcement can be selectably located and deployed in a manner that avoids interference with any desired location of the bottom safety member.

BRIEF DESCRIPTION OF THE DRAWINGS

FIG. 19 is a central cross-sectional front elevational view showing the stanchion of the invention in a secondary embodiment: a cost-reduced alternative with only one compression element, retained in place by an unthreaded core rod, requiring only four unthreaded holes in the stanchion arcuate walls providing a choice between two selectable compression element locations.

FIG. 20 is an enlarged cross-section of the post assembly of FIG. 19, taken through axis 20-20' (FIG. 19).

FIG. 21 is a central cross-sectional front elevational view showing an embodiment with a compression element held in place by the bottom safety element traversing a through-hole configured in the compression element.

FIG. 22 is an enlarged cross-section of the post assembly of FIG. 21, taken through axis 22-22' (FIG. 21), showing the circular disk shape of the compression element, held in place by the bottom safety element traversing the through-hole.

FIG. 23 is an enlarged central cross-sectional front elevational view showing a post assembly wherein an embodiment of the stanchion of the invention is made with a stepped configuration internally that provides two ledges at different elevations as selectable locations for support of a disk-shaped compression element of corresponding size selected from two sizes made available.

FIG. 24 is an enlarged top view of the post assembly of FIG. 23 with the disk-shaped compression element removed to show the two concentric circular ledges configured internally.

FIG. 25 is an enlarged cross-section showing a variation wherein the core rod is implemented as a countersunk flathead machine screw instead of the grub screw of the preferred embodiment as shown in FIG. 20.

FIG. 26 is an enlarged cross-section of a post assembly utilizing an alternative embodiment of the stanchion of the present invention wherein the reinforcing compression element is implemented as a fully-threaded grub screw with ends engaging corresponding threaded holes selected from a vertical array in each of the arcuate sidewalls.

FIG. 27 is a front elevational view of a lower portion of a post assembly of a handrail system utilizing a stanchion of the present invention in an embodiment wherein the flange portion is attached pivotedly to the upright portion for installation on an inclined base surface.

DETAILED DESCRIPTION

Figure 1:
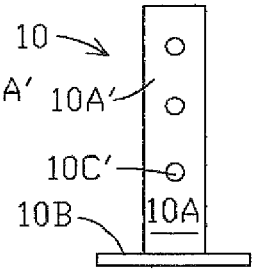
FIG. 1 is a front elevational view of a stanchion in a preferred embodiment of the present invention.

FIG. 1 is a front elevational view of a stanchion 10 of the present invention showing the basic structure of an upright portion 10A integrally attached to a bottom mounting flange portion 10B. A preferred embodiment is configured with a vertical array of three unthreaded holes 10C in the front arcuate sidewall 10A', visible in this view. At the rear of stanchion 10, not visible in this FIG. 1 view, a second arcuate sidewall of identical outline shape is located in mirror-image relation. (see FIG. 4).

Figure 2:
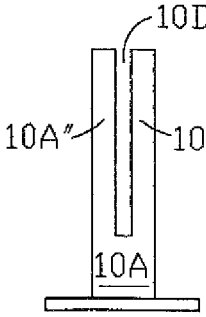
FIG. 2 is a first side view of the stanchion of FIG. 1

FIG. 2 is a side view of the stanchion 10 of FIG. 1 showing the upright portion 10A with its major upper portion bifurcated into two arcuate sidewalls 10A' and 10A", separated by a pair of vertical slots 10D extending from closed lower ends located at a designated height above the flange portion (10B, FIG. 1) to their open upper ends located at the top edge of upright portion 10A.

Figure 3:
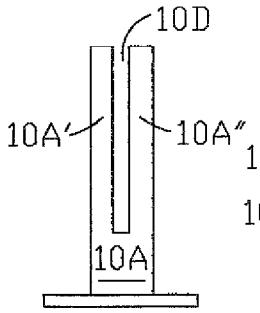
FIG. 3 is a second and opposite side view of the stanchion of FIGS. 1 and 2.

FIG. 3 is the opposite side view of the stanchion of FIGS. 1 and 2, showing the bifurcated upright portion forming a vertical slot 10D, aligned with the opposite vertical slot 10D (FIG. 2), between the two arcuate sidewalls 10A' and 10A".

Figure 4:
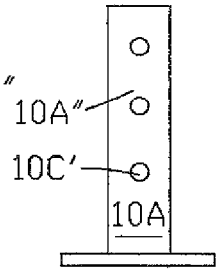
FIG. 4 is a rear view of the stanchion of FIGS. 1-3.

FIG. 4 is a rear view of the stanchion of FIGS. 1-3 showing a vertical array of three threaded holes 10C' configured in arcuate sidewall 10A" located diametrically opposite and aligned with the vertical array of the three unthreaded holes 10C in FIG. 1.

Figure 5:
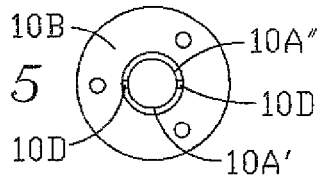
FIG. 5 is a top view of the stanchion of FIG. 1.

FIG. 5 is a top view of stanchion 10 of FIG. 1, showing the circular outline shape of flange portion 10B and the top edges of the two arcuate sidewalls 10A' and 10A", spaced apart, mirror image, by the open top ends of vertical slots 10D (FIGS. 2 and 3), and showing three holes in flange 10B for fastening to the underlying base surface.

Figure 6:
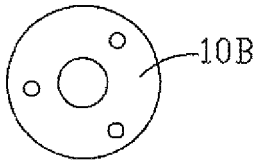
FIG. 6 is a bottom view of the stanchion of FIG. 1.

FIG. 6 is a bottom view of the stanchion of FIG. 1 showing flange portion 10B with the three fastening holes.

Figure 11:
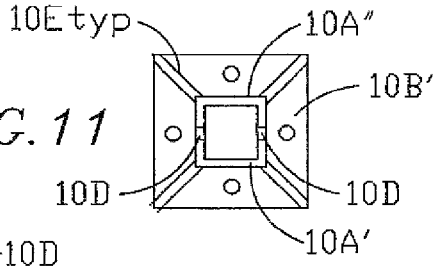
FIGS. 7-12, corresponding to FIGS. 1-6 respectively, depict an alternative embodiment of the present invention for handrail posts of square cross-sectional shape.
Figure 8:
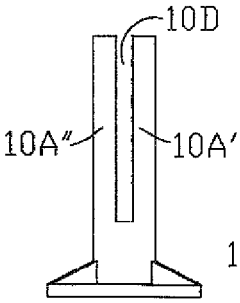

FIGS. 7-12, corresponding to FIGS. 1-6 respectively, depict an alternative embodiment of the present invention wherein, instead to the circular cross-sectional shape of the upright portion 10A shown in FIG. 5, the shape is made square, as seen in FIG. 11, to accommodate a hollow handrail post of square cross-sectional shape. The four corner gusset braces 10E shown provide reinforcement to enhance the working strength of the square flange portion 10B'.

Figure 7:
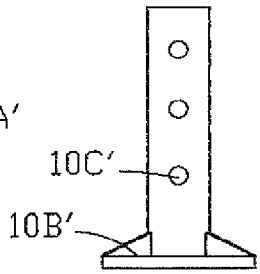
Figure 9:
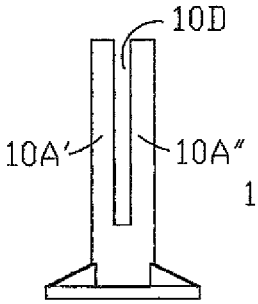
Figure 10:
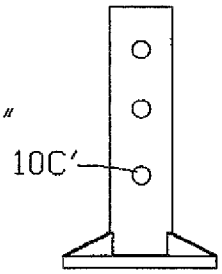
Figure 12:
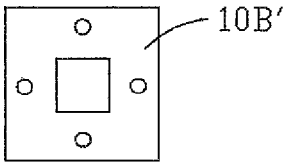

In this preferred embodiment, the three unthreaded holes 10C in arcuate sidewall 10A' in FIGS. 1 and 7, and the three threaded holes 10C' in arcuate sidewall 10A" in FIGS. 4 and 10, are arranged in vertical arrays to provide a choice between three locations at different heights for support of a pair of spacer compression members to reinforce the arcuate sidewalls 10A' and 10A" of the upright portion 10A.

Figure 13:
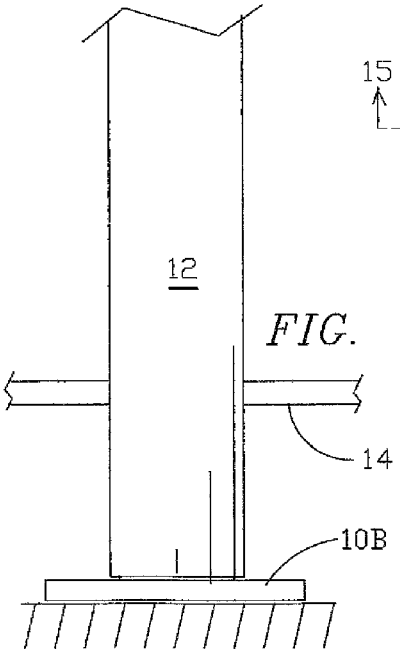
FIG. 13 is an enlarged front elevational view of a lower portion of a handrail system utilizing a stanchion of the present invention in a post assembly traversed by a bottom safety member of the handrail system.

FIG. 13 is an enlarged front elevational view showing the lower portion of a handrail post assembly with a hollow post 12 installed surrounding the upright portion of a stanchion according to the present invention, exposing only the flange portion 10B. Although normally held in place by gravity alone, for added security the post 12 is preferably fastened in place on the stanchion using epoxy or equivalent industrial adhesive. Also shown is a portion of a horizontal bottom safety member 14 traversing the post assembly.

Figure 14:
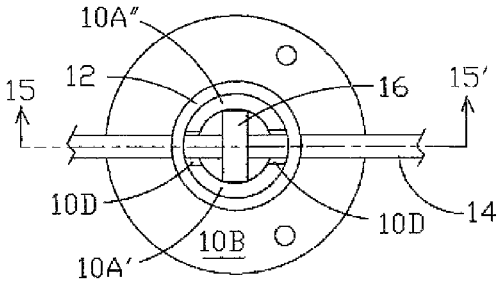
FIG. 14 is a top view of the post assembly of FIG. 13 showing the top edges of a pair of arcuate sidewalls formed by bifurcation of the stanchion and reinforced by an interposed compression member in a preferred embodiment of the present invention.

FIG. 14 is a top view of the post assembly of FIG. 13 showing the circular outline of flange portion 10B and showing the bottom safety member 14 traversing the post assembly through holes drilled in post 12 at installation. Internally, bottom safety member 14 traverses the two slots 10D between the two arcuate sidewalls 10A' and 10A" of the stanchion upright portion 10A, surrounded by post 12. A compression member implemented as a sleeve 16, interposed between the inner surfaces of the two arcuate walls 10A' and 10A", serves to reinforce the stanchion against potential damage from lateral forces impacting the handrail system. Multiplied by leverage at the post 12, these forces translate into extremely strong lateral compressive forces applied to the stanchion as the axis of leverage, tending to bend the arcuate sidewalls 10A' and 10A" inwardly toward each other. Compression sleeve 16, spacing them apart, enables them to support each other, providing the stanchion, as effectively the "backbone" of the handrail system, with reinforcement that at least doubles the working strength compared to the same stanchion without reinforcement.

Figure 15:
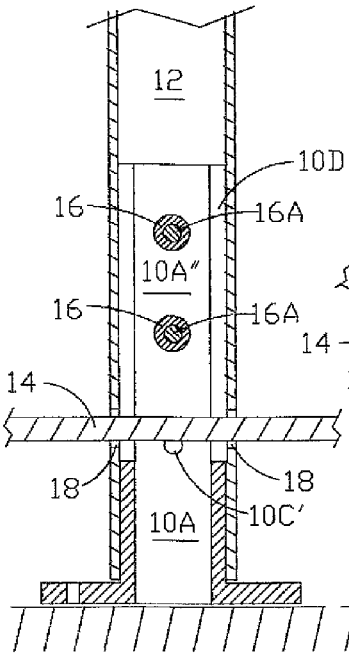
FIG. 15 is a central cross-sectional front elevational view of the post assembly of FIG. 13 showing the stanchion in the preferred embodiment with two compression members deployed in a first location mode to avoid interference with the horizontal bottom safety member below.

FIG. 15 is a central elevational cross-section of the post assembly of FIG. 13, taken at axis 15-15' of FIG. 14, showing two compression sleeves 16 each surrounding and retained in place by core rod member implemented as an elongate grub screw core 16A and deployed in a first location mode wherein the upper and middle hole locations of the vertical array have been selected for installing the two compression sleeves 16, leaving the lower threaded hole 10C' unoccupied as shown, thus enabling the bottom horizontal safety member 14 to be located anywhere in the vicinity of the selected location shown, near the low end of the available location range extending from the bottom of slots 10D upward, obstructed only at the middle location of compression sleeve 16 and unobstructed at the lower location of unoccupied threaded hole 10C'.

Figure 16:
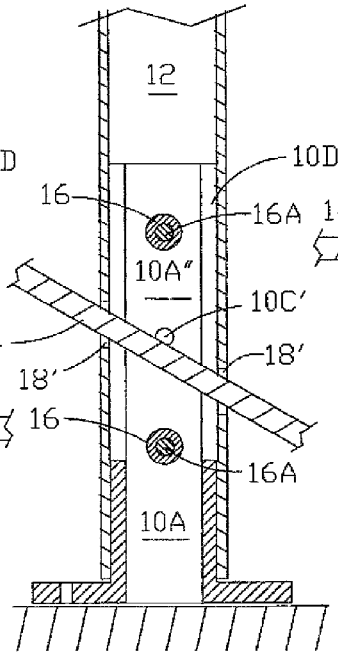
FIG. 16 is a cross-section of the post assembly of FIG. 13 showing the compression members deployed in a second location mode to avoid interference with the bottom safety member inclined for a stairway installation.

FIG. 16 is a central elevational cross-section of the post assembly of FIG. 13 showing the compression sleeves 16 (with grub screw cores 16A) deployed in a second location mode wherein the upper and lower hole locations of the vertical array have been selected for installing the two compression sleeves 16, leaving the middle threaded hole 10C' unoccupied, enabling the bottom safety member 14 to be inclined for a stairway or sloped installation and located anywhere between the upper and lower locations as shown, in a mid-range region that is unobstructed at the middle location of the unoccupied threaded hole 10C'.

Figure 17:
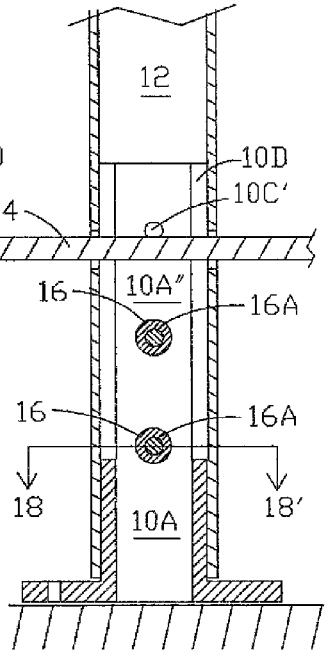
FIG. 17 is a cross-section of the post assembly of FIG. 13 showing the compression members deployed in a third location mode to avoid interference with the horizontal bottom safety member, which can be located anywhere above the upper compression member.

FIG. 17 is a central elevational cross-section of the post assembly of FIG. 13 showing the compression sleeves 16 (with grub screw cores 16A) deployed in a third location mode wherein the middle and lower hole locations of the vertical array have been selected for installing the two compression sleeves 16, leaving the upper threaded hole 10C' unoccupied, thus enabling the bottom horizontal safety member 14 to be located as shown or anywhere in the unobstructed range above the upper compression sleeve 16, unobstructed at the upper location of the unoccupied threaded hole 10C'.

Figure 18:
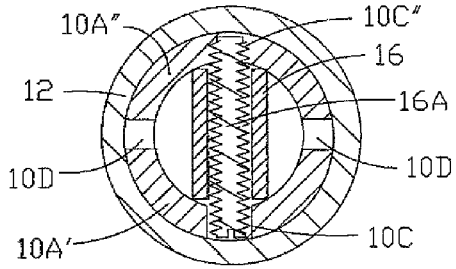
FIG. 18 is an enlarged cross-section of the post assembly of FIG. 13 taken through axis 18-18" (FIG. 17).

FIG. 18 is an enlarged cross-section of the post assembly of FIG. 13 taken at axis 18-18' of FIG. 17, showing the arcuate sidewalls 10A' and 10A', separated by the two slots 10D, and showing the lower compression element, i.e. sleeve 16, held in place by threaded grub screw core 16A, having a head end configured with a screwdriver slot, slidingly occupying an unthreaded hole 10C as selected from the three unthreaded holes vertically arrayed in first arcuate sidewall 10A', the opposite end of grub screw core 16A being threadedly engaged in the corresponding one of the three threaded holes 10C' vertically arrayed in the second arcuate sidewall 10A".

As a refinement and installation convenience in the preferred embodiment, instead of headless grub screw 16' being fully threaded as shown in FIG. 18, making it threaded only over a short end region sized to automatically establish its working location when tightened to a bottomed condition.

FIG. 19 is a central elevational cross-section of a post assembly of a secondary embodiment of the invention constituting a cost-reduced alternative version of the above-described preferred embodiment, the main difference being that instead of two compression elements and three-hole vertical arrays enabling three location modes as described above in connection with the post assembly shown in FIGS. 15-17, this secondary embodiment utilizes only a single compression element, i.e. compression sleeve 16, thus requiring only two selectable hole-pair locations as shown, enabling two location modes. The lower location in the preferred embodiment was selected for elimination as contributing least of the three to reinforcement strength, the middle and upper locations being retained in this secondary embodiment.

FIG. 20 is an enlarged cross-section of the secondary embodiment post assembly of FIG. 19 taken at axis 20-20' (FIG. 19), showing the compression element implemented as an unthreaded core rod 16A with ends occupying unthreaded holes 10C in the two identical arcute sidewalls 10A', surrounded by tubular post 12 which retains unthreaded core rod 16A in place, slidingly fitted within compression sleeve 16, which is sized in length and preferably end-shaped for a close fit at the interfaces with the arcuate sidewalls 10A of the bifurcated upright portion of the stanchion so as to enable the two arcuate sidewalls 10A to reinforce each other against deformation from external lateral forces impacting the handrail system.

This secondary embodiment version of compression element retention shown in FIGS. 19 and 20 provides benefits of cost reduction in manufacture while preserving full operating strength compared to the preferred embodiment described above; however there is potential of some nuisance disadvantage in handling an assembled stanchion in installation prior to insertion into a post: core rod 22A', being unthreaded, slidingly fitted and relying on the presence of a surrounding post for retention, could shift endwise and fall out.

The cross-sectional outline shape of compression sleeve 16 in the preferred and secondary embodiments described above is not critical: it can be made as a circular annular sleeve as shown or the outline can be made any desired shape, e.g. rectangular or square or even extended further e.g. instead of a sleeve, a circular compression disk filling the interior cross-sectional space of the upright portion 10A of the stanchion.

FIG. 21 is a central elevational cross-section of a post assembly showing an alternative approach for stanchion reinforcement wherein the compression element is implemented as a circular compression disk 20 retained in place by a horizontal lower safety member 14 traversing a central through-hole in disk 20 as shown.

FIG. 22 is an enlarged cross-section of the post assembly of FIG. 21, taken through axis 22-22' (FIG. 21), showing the circular shape of the compression disk 20, retained in place by the bottom safety element 14 traversing the through-hole, which is aligned with slots 10D in the arcuate sidewalls 10A'.

FIG. 23 is a central elevational cross-section of a post assembly showing another alternative approach for stanchion reinforcement wherein an identical pair of arcuate sidewalls 10F are made with a stepped configuration internally that provides two concentric ledges 22 and 24 at different elevations strategically designated as selectable locations for support of either a larger compression disk 20' as shown supported on the upper ledge 22, or a smaller compression disk 20" shown in broken outline on the lower ledge 24. Holes and threading are eliminated, and the increased stanchion wall thickness contributes a beneficial increase in working strength.

FIG. 24 is an enlarged top view of the post assembly of FIG. 23 with the compression disk removed to show the two different sizes of the concentric circular ledges 22 and 24 configured internally.

FIG. 25 is an enlarged cross-section showing a variation in reinforcement wherein retainment of the compression element in place is implemented as a fully or partially threaded flathead (or oval-head) machine screw 16A" in a countersunk hole in arcuate sidewall 10" instead of the grub screw core 16A of the preferred embodiment with its head end occupying an unthreaded hole as shown in FIG. 18. This variation enables the arcuate sidewalls to be drawn into firm contact with the compression element when the core screw is tightened.

FIG. 26 is an enlarged cross-section of a post assembly utilizing an alternative embodiment of the stanchion of the present invention wherein the reinforcing compression element is implemented as a fully-threaded grub screw 16 (optionally larger than in FIG. 18) with ends engaging a corresponding pair of threaded holes 10C" selected from the vertical array of threaded holes 10C" in each of the identical arcuate sidewalls 10A".

FIG. 27 is a front elevational view of a lower portion of a post assembly of a handrail system utilizing a stanchion of the present invention in an embodiment wherein the flange portion 10B" is attached pivotedly to the upright portion for installation on an inclined base surface. The bottom end of pipe 12' is cut off at the designated angle Alternatively, flange portion 10B" could be attached integrally at a desired fixed slope angle.

The invention can be practiced in an alternative basic embodiment wherein the two arcuate sidewalls are made identical in basic form with no reinforcement items or associated support holes required. Their appearance would be as shown in the drawings including vertical slots 10D but with all holes omitted. Full design exploitation of the three main parameters in the design tradeoffs, i.e. the strength of the material of the stanchion, the wall thickness of its upright portion 10A, and the designated height of the slot lower ends above the flange, may enable this basic embodiment to be made sufficiently strong alone without need for any reinforcement compression member, thus also eliminating the need for any support holes, threading or countersinking in the arcuate sidewalls.

There are numerous variations possible in the flange portion 10B with which the principle of the invention could be practiced within its spirit and scope, including outline shapes other than circular or square as shown, integrated with or enclosed in underlying structure, e.g. embedded in concrete.

As alternatives to a single core rod 22', the compression element may be retained in place by a pair of core pins or screws occupying and preferably threadedly engaging a pair of holes configured in either the opposite ends of the compression element 22 or opposite locations in each of the two arcuate sidewalls, with head ends configured for driving. If the screws are made flatheaded and the threaded hoeds located at the ends of the compression element 22, this arrangement could also potentially enable the flathead screws to provide some additional strength enhancement to the stanchion by enabling tightening of the arcuate sidewalls against the ends of the reinforcement compression sleeve(s).

The foregoing modifications can retain full versatility and required strength while reducing costs by reducing the number of holes and/or the amount of threading required.

The invention can be practiced in an alternative basic embodiment which requires no reinforcement items or associated support holes, and wherein the two arcuate sidewalls are made identical, appearing as shown in the drawings including vertical slots 10Dtyp but with all holes omitted. Full design exploitation of the three main parameters in the design tradeoffs, i.e. the strength of the material of the stanchion, the wall thickness of its upright portion, and the designated height of the slot lower ends above the flange, may enable this basic embodiment to be made sufficiently strong alone without need for any reinforcement compression member, thus also eliminating the need for any support holes, threading or countersinking in the arcuate sidewalls.

Regarding overall handrail system strength considerations: assuming a given required width of slots 10D to provide a clear passageway for a traversing safety element, the main parameters in the design tradeoffs are the strength of the material of the stanchion, the wall thickness of its upright portion, and the designated height of the lower slot ends above the flange. Judicious selection of values for these parameters, which in combination dictate the amount of reinforcement required between the two arcuate sidewalls.

The invention may be embodied and practiced in other specific forms without departing from the spirit and essential characteristics thereof. The present embodiments are therefore to be considered in all respects as illustrative and not restrictive, and all variations, substitutions and changes which come within the meaning and range of equivalency of the claims are therefore intended to be embraced therein.

What is claimed is:

1. A stanchion, for installation into the lower end of a tubular post to form a post assembly of a handrail system which includes an inter-post bottom safety member of designated size passing through a pair of holes drilled in the post, comprising:

a flange portion secured to an underlying base region; and a hollow vertical upright portion, attached at a bottom end to said flange portion and bifurcated so as to form a mirror-image pair of arcuate sidewalls separated at side edges by a pair of vertical slots extending upwardly from closed low ends located at a designated spacing above said flange portion to open ends at a top edge of said upright portion, the slots being sized in width to allow the bottom safety member of the handrail system to pass through the post assembly via a pair of holes drilled in the post at any desired spacing above said flange portion, with never any need for drilling said stanchion;

at least one compression member, made and located to serve as a spacer between the arcuate sidewalls to reinforce said upright portion against risk of deformation damage from external forces impacting the handrail system; and compression member retaining structure, associated with each said at least one compression member, made and arranged to retain said compression member in place relative to the arcuate sidewalls while avoiding interference with any desired location of the bottom safety member and avoiding any need for drilling said stanchion; and a set of openings, sized to fit ends of said compression member retaining structure, arranged as a pair of matching and aligned vertical arrays configured one in each arcuate sidewall, providing at least two pairs of openings, each pair located at a different elevation above said flange portion, each elevation providing a location of a pair of openings that can be selected for installing one said compression member retaining structure, said set of openings made to have a quantity of pairs that exceeds said at least one compression member in quantity.

2. The stanchion as defined in claim 1 wherein said flange portion is configured with a flat bottom surface interfacing and secured to the base region beneath the post.

3. The stanchion as defined in claim 1 wherein said flange portion is enclosed in a base region beneath the post.

4. The stanchion as defined in claim 1 wherein said vertical upright portion is fixedly attached to said flange portion in coaxial relationship, holding said flange portion horizontal and perpendicular to said upright portion.

5. The stanchion as defined in claim 1 wherein said vertical upright portion is attached at a predetermined fixed slope angle relative to said flange portion, for installation on a sloping base surface.

6. The stanchion as defined in claim 1 wherein said upright portion is attached to said flange portion in a pivoted manner enabling the bottom surface of said flange portion to be set at any desired slope angle relative to said vertical upright portion.

7. The stanchion as defined in claim 1 wherein each opening of said set of openings being threaded; and each said compression member being made cylindrical and elongate in shape, threaded end-to-end, and installed with each end occupying and threadedly engaging a corresponding one of a selected pair of the threaded openings, one in each arcuate sidewall.

8. The stanchion as defined in claim 1 wherein said compression member retaining structure comprises:

a core member having a major cylindrical portion traversing a central passageway configured in said compression member, said core member having a head end configured with a driving recess and being sized in length to extend beyond both ends of said compression member and occupy a selected pair of openings, one in each arcuate sidewall; and whereby an installer is enabled to choose therefrom a location for each of said at least one compression member that avoids interference with any desired location of the bottom safety member, with never any need for drilling said stanchion.

9. The stanchion as defined in claim 8 wherein:

the openings in the vertical array in a first one of the arcuate sidewalls are unthreaded and sized for a sliding fit surrounding said core member;

the openings in the vertical array in a second one of the arcuate sidewalls are threaded to threadedly engage said core member; and said core member is implemented as a cylindrical rod, threaded at least in an end region opposite the head end, and installed with the head end traversing a corresponding unthreaded opening in the first arcuate sidewall, and the threaded end threadedly engaging a selected threaded opening in the second arcuate sidewall.

10. The stanchion as defined in claim 9 wherein said core member is threaded at least in an end region, and installed traversing a selected unthreaded opening in the first arcuate sidewall and threadedly engaging the corresponding coaxial threaded opening in the second arcuate sidewall.

11. The stanchion as defined in claim 10 wherein:

said core member is implemented as a flathead machine screw; and the openings in the vertical array in the first arcuate sidewall are configured at their outer extent to countersink the flathead machine screw;

whereby reinforcement can be enhanced by the flathead machine screw, when tightened, serving to secure the arcuate sidewalls in firm contact against the ends of said compression member.

12. The stanchion as defined in claim 10 wherein:

said core member is implemented as an oval-head machine screw; and the openings in the vertical array in the first arcuate sidewall are configured at their outer extent to countersink the oval-head machine screw;

whereby reinforcement can be enhanced by the oval-head machine screw, when tightened, serving to secure the arcuate sidewalls in firm contact against the ends of said compression member.

13. The stanchion as defined in claim 8 wherein:

said at least one compression member comprises only one compression member;

said set of openings comprises four openings arranged as two vertical arrays of two openings, one array in each arcuate sidewall, the two arrays matching and aligned with each other, whereby the installer is enabled to choose between two reinforcement locations, i.e. lower and upper, in order to avoid interference with any desired location of the bottom safety member, with never any need for drilling said stanchion.

14. The stanchion as defined in claim 8 wherein:

said at least one compression member comprises two compression members; and said set of openings comprises six openings arranged as two vertical arrays of three openings, one array in each arcuate sidewall, the two arrays matching and aligned with each other;

whereby the installer is enabled to choose between three reinforcement location modes, i.e. upper+middle, upper+lower, and middle+lower, in order to avoid interference with any desired location of the bottom safety member, with never any need for drilling said stanchion.

15. The stanchion as defined in claim 14 wherein:

said core member, implemented as a grub screw, i.e. a fully threaded cylindrical rod; and the driving recess in its head end is a screwdriver slot.

16. The stanchion as defined in claim 8 wherein: all of the openings in the vertical arrays in both arcuate sidewalls are unthreaded and sized for a sliding fit surrounding said core member; said core member is implemented as an unthreaded cylindrical rod with ends each occupying a corresponding one of a selected pair of the unthreaded openings, and retained in place by a surrounding post.

17. The stanchion as defined in claim 1 wherein:

said compression member is implemented as a cylindrical disk sized to extend to an inner periphery of the arcuate sidewalls and configured with a horizontal through-opening; and said compression member retaining structure comprises a safety member traversing a pair of holes drilled in an associated post, traversing the two slots between the two arcuate sidewalls and traversing the horizontal through-opening.

18. The stanchion as defined in claim 1 wherein: said compression member retaining structure comprises the arcuate sidewalls being made identical, configured internally with a first coaxial horizontal ledge and a second similar ledge, made smaller in diameter than the first ledge and located at a designated distance beneath the first ledge; and said compression member is implemented as a cylindrical disk made available in two sizes of different diameter to fully occupy regions immediately above each of the two ledges respectively;

whereby the installer is enabled to choose between two reinforcement location modes, (a) the larger first compression disk supported on the first ledge and (b) the smaller second compression disk supported on the lower ledge, in order to avoid interference with any desired location of the bottom safety member, with never any need for drilling said stanchion.

* * * * *